United States Patent [19]

Deiner et al.

[11] 4,390,650

[45] Jun. 28, 1983

[54] PROCESS FOR MAKING FIBROUS MATERIAL WATER REPELLENT

[75] Inventors: Hans Deiner, Neusäss; Willy Bernheim, Diedorf, both of Fed. Rep. of Germany

[73] Assignee: Ciba-Geigy Corporation, Ardsley, N.Y.

[21] Appl. No.: 301,569

[22] Filed: Sep. 14, 1981

[30] Foreign Application Priority Data

Sep. 23, 1980 [DE] Fed. Rep. of Germany ..... 3035824

[51] Int. Cl.[3] ..... C08L 83/06

[52] U.S. Cl. ..... 524/266; 427/381; 427/382; 427/386; 427/387; 427/389; 427/389.9; 427/391; 427/392; 427/393; 427/393.4

[58] Field of Search ..... 427/386, 381, 387, 382, 427/389.9, 389, 393.4, 392, 391, 428, 274; 524/501, 503, 859, 860, 863, 864, 715, 714, 722, 266

[56] References Cited

U.S. PATENT DOCUMENTS

| | | | |
|---|---|---|---|
| 3,418,162 | 12/1968 | Adachi et al. | 427/387 |
| 3,668,228 | 6/1972 | Zbinden et al. | 252/431 C |
| 3,772,351 | 11/1973 | Krahnke | 260/448.2 E X |

FOREIGN PATENT DOCUMENTS

| | | |
|---|---|---|
| 1282597 | 11/1968 | Fed. Rep. of Germany . |
| 1769666 | 12/1970 | Fed. Rep. of Germany . |
| 2047919 | 4/1971 | Fed. Rep. of Germany . |
| 2346665 | 3/1975 | Fed. Rep. of Germany . |
| 1575695 | 1/1969 | France . |
| 949959 | 2/1964 | United Kingdom . |
| 961064 | 6/1964 | United Kingdom . |
| 1056808 | 2/1967 | United Kingdom . |
| 1123447 | 8/1968 | United Kingdom . |
| 1404356 | 8/1975 | United Kingdom . |

OTHER PUBLICATIONS

Abstract-"Uran und-verbindungen", pp. 784-788.

Abstract-CPI-Basic Aleract Journal, 1975, J74047-436.

Abstract-F6: Chemical Treatment, p. 25, NATR, "Water-Repellant cmpsns., etc."

Abstract-A2: Condensation Polymers, p. 3-17891Q, Rapid Curing Polydimethysiloxane Release Coating Compound.

Abstract-South Africa, Jun. 1971, Week S26.

*Primary Examiner*—Norman Morgenstern
*Assistant Examiner*—Thurman K. Page
*Attorney, Agent, or Firm*—Edward McC. Roberts

[57] ABSTRACT

Process for making fibrous material water repellent by treating it with an aqueous bath containing (A) an emulsified organo polysiloxane with at least 2 hydroxyl groups optionally modified in a manner able to cross-link, (B) a non-ionic emulsion of poly silicic acid ester, (C) a reaction product which has been obtained by reaction of an organic compound containing at least one halohydrin and/or epoxy group with an organic compound containing hydrogen atoms bound to nitrogen, which in form of its salt is water-soluble or at least water-dispersible.

The treated material is dried and optionally cured.

8 Claims, No Drawings

PROCESS FOR MAKING FIBROUS MATERIAL WATER REPELLENT

The present invention concerns a process for making fibrous materials water-repellent, the fibrous materials being treated with aqueous baths which contain an emulsified organopolysiloxane with at least two, possibly modified hydroxyl groups, an emulsion of poly silicic acid ester and a reaction product which has been obtained by reaction of an organic compound containing at least one halogen hydrin and/or epoxy group with an organic compound containing hydrogen atoms bound to nitrogen, which compound in form of its salt is water-soluble or at least water-dispersable. The thus treated materials are then finished (e.g. dried and cured) in usual manner.

From DE-AS 12 82 597 a process is known for making textiles water-repellent by treating them with aqueous emulsions of organopolysiloxanes containing hydroxyl groups, silicic acid esters and a catalyst combination of esters of zirconium or titanium acid with aliphatic tertiary amines which contain at least 2 $\beta$-hydroxy alkyl groups, and water-soluble salts of zinc or cadmium with organic or inorganic acids and which are subsequently heated shortly. This known process gives only insufficient water-repellent effects which do not fulfill the present standard required in this field (see comparative tests in example 1).

In order to obtain good water-repellent effects on fibrous materials it is, therefore, absolutely necessary, to apply always alkyl hydrogen polysiloxanes as organopolysiloxanes or to use them at least as cross-linking agent for organopolysiloxanes which contain groups able to cross-link. These hydrogen polysiloxanes, however, have in emulsified form the trend to split off hydrogen which has as consequence a loss of its effectiveness. Moreover, storage has become more difficult.

So it was the purpose of the present invention to obtain in the absence of organo hydrogen polysiloxanes good water-repellent effects on fibrous materials. This task was achieved by the process according to the present invention.

Therefore, it is one object of the present invention to provide a process for making fibrous materials, especially textile materials, water-repellent, which comprises treating the fibrous material with an aqueous bath containing (A) an emulsified organopolysiloxane with at least 2, preferably terminal, hydroxyl groups, optionally modified to make then cross-linkable, (B) an emulsion of a poly silicic acid ester of monovalent alcohols with 1 to 4 carbon atoms, which has been emulsified by the aid of a non-ionic emulsifier, and shows a pH-value of 5 to 7.5, and (C) a reaction product of an organic compound containing at least one halohydrin and/or epoxy group and an organic compound containing hydrogen atoms bound to nitrogen, which reaction product is water-soluble or at least water-dispersable when in form of its salt, drying the treated material and optionally curing it.

Another object of the present invention is the aqueous emulsion/dispersion containing components (A), (B) and (C), for carrying out the inventive process.

The used organopolysiloxanes are known (see e.g. "Ullmanns Encyklopädie der technischen Chemie", Verlag Urban und Schwarzenberg, München-Berlin, volume 15, (1964), pages 784 ff, paragraph "Silikonkautschuk"). Preferably such organopolysiloxanes are used which contain terminal hydroxyl groups. These hydroxyl groups, however, can, indeed, also be modified, the cross-linkability of these groups, must, however, be guaranteed. Moreover, the organo polysiloxanes are usual dialkyl-, especially dimethyl polysiloxanes modified by special substituents. The alkyl-, especially methyl groups in the polysiloxanes containing reactive end groups can be substituted by phenyl-, benzyl-, ethylphenyl- or ethyl groups. Besides, organo polysiloxanes are also important in which a part of the alkyl groups is replaced by unsaturated organic groups, e.g. vinyl groups.

The described organo polysiloxanes are emulsified by the aid of non-ionic or cationic emulsifiers. Here especially polyvinyl alcohols come into consideration as non-ionic emulsifiers. But ethylene oxide reaction products of higher fatty acids, fatty alcohols, fatty acid amides and higher amines are also suitable. The ethoxylation products of the higher amines can also be used in form of their salts with low molecular carboxylic acids, such as acetic-, formic- or propionic acid or mineral acids, such as hydrochloric acid, hydrobromic acid or sulphuric acid. Examples for such emulsifiers are e.g. described in GB-PS 1 404 356 and U.S. Pat. No. 3,748,275.

As cationic emulsifiers quaternary ammonium salts can be mentioned. Examples for such compounds are lauryl- or cetylbenzyldimethylammoniumchloride or octadecyloxymethylpyridiniumchloride.

The reaction products (C) are especially preferably applied as emulsifiers for the organo polysiloxanes (see following comments). By this the separate addition of these reaction products to the finishing bath is not necessary and due to this fact their manufacture is still essentially simpler. The mentioned emulsifiers are applied in a quantity of at least 4% by weight, especially 10–40% by weight-calculated as a 100% emulsifier-referred to the organo polysiloxane with at least two, preferably terminal, optionally etherified or esterified, cross-linkable hydroxyl groups.

The manufacture of organo polysiloxane emulsions (A) can be made according to known processes so that further comments on this subject are not necessary. A usual process is, e.g. described in the already mentioned GB-PS 1 404 356.

The poly silicic acid esters which derive from silicic acid esters of monovalent alcohols with 1 to 4 carbon atoms, applied according to the invention, have a molecular weight of approx. 300 to 750. Examples are methyl-, n-propyl-, n-butyl-polysilicate and especially ethyl polysilicate. As comparative tests have shown monomer silicic acid esters are less suitable for the process according to the invention and it is surprising that the described poly silicic acid esters have such an excellently favourable influence upon the water-repellent effect.

The mentioned poly silicic acid esters are emulsified by the aid of non-ionic emulsifiers. As non-ionic emulsifiers the above mentioned compounds can be used, these compounds being applied in an amount of about 4 to 40% by weight referred to poly silicic acid ester.

The manufacture of the emulsions of the poly silicic acid esters can be made in known manner. For this purpose a preemulsion is produced at first which is then converted, e.g. by high pressure homogenizing, into a stable, storable emulsion. If non-ionic emulsifiers are used for the manufacture of emulsions (B) it is easily possible to carry out the emulsification of the organo polysiloxane together with the emulsification of poly silicic acid ester.

The reaction products (C) employed furthermore according to the invention are known as such. They are described in the literature as emulsifiers for water insoluble substances, but also as hardening agents for silicones (see U.S. Pat. Nos. 3,320,197, 3,848,022, 3,729,437 and 3,211,580 as well as GB-PS 1 056 808). In general, these reaction products are obtained by reacting organic compounds which contain at least one halohydrin and/or epoxy group with a compound containing hydrogen atoms bound to nitrogen, whereby reaction products result which are in the form of salts water soluble or at least water dispersable.

As organic compounds with at least one halohydrin- and/or epoxy group there should be mentioned e.g. glycidyl- or halogen-, especially chlorohydrin, ether of polyvalent phenols, such as 4,4'-dihydroxydiphenylpropane and -methane, resorcinol or of polyvalent aliphatic alcohols, such as ethylene- and propyleneglycol, glycerin, polyalkylene glycols and sorbitol or the glycidyl- or halogenhydrin ester of dicarboxylic acids, such as adipic acid or terephthalic acid as well as mixtures of the mentioned compounds. Moreover, organo polysiloxanes containing epoxy groups are suitable. Generally the compounds containing epoxy groups are preferred for practical reasons.

As organic compounds with hydrogen atoms bound with nitrogen the following should be mentioned: Di- or polyamines, such as ethylene and propylene diamine, diethylene triamine, triethylene tetramine, dipropylene triamine, cycloaliphatic diamines, such as 1,4-diaminocyclohexane and heterocyclic compounds with at least 2 secondary amine groups, such as piperazine.

As such compounds further urea, imino urea (guanidine) or their derivatives are suitable. Examples of such derivatives are acetoguanidine, aminoguanidine, cyanamide, dicyandiamide, melamine, biuret, alkyl or arylguanamines, such as benzo-, aceto-, butyro, coconut- or stearoguanamine, ethylene urea, propylene urea, thiourea, dihydroxyethylene urea, oxypropylene urea, N-methylurea and N,N-diethylurea (U.S. Pat. No. 3,729,437). If these compounds are used for the manufacture of the reaction products (C) it is necessary to use still concurrently compounds of the formula

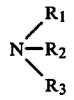

(1)

in which $R_1$ is an alkyl group with 2 to 4 carbon atoms or an alkanol group with 2 to 5 carbon atoms, $R_2$ and $R_3$ independent of each other hydrogen, an alkyl group with 1 to 4 carbon atoms or an alkanol group with 2 to 5 carbon atoms and in the molecule at least 2 reactive hydrogen atoms are contained. If $R_2$ and $R_3$ are hydrogen these compounds can also be used in the absence of urea or the urea derivatives for the manufacture of the reaction products (C). Examples for these compounds are described in U.S. Pat. No. 3,725,502.

Such components (C) are preferred which are reaction products of said epoxy compounds and said di- and/or polyamines, wherein the ratio of epoxy groups to amine hydrogen atoms are 1:(⅓–10).

Further preferred are reaction products of (a) 0.25 to 2.5 mols of said epoxy compounds containing per mol on the average more than one epoxy group,
(b) 1 mol of urea, imino urea or their derivatives, and
(c) 0.1 to 2 mols of an amine of formula (1).

Both the organic compounds with at least one halohydrin and/or epoxy group and the organic compounds with hydrogen atoms bound to nitrogen can be substituted wholly or partially by lipophilic residues, such as higher molecular alkyl-, alkylcycloalkyl- and/or alkylaryl residues with at least 8, preferably 12 to 18 carbon atoms. Examples for halohydrin- and/or epoxy compounds containing lipophilic groups are the reaction product of 1 mol coconut fatty amine with 2 mols epichlorohydrin and the bischlorohydrin ether of the glycerol monolauric acid ester. Examples for the compounds mentioned furthermore are: N-stearyl ethylene diamine, N-acylamido amine and reaction products of fatty alcohol monochlorohydrin ethers or fatty acid chlorohydrin esters and di- or polyamines. When using starting materials containing the lipophilic residues it is also sufficient if only one of the starting materials for the manufacture of component (C) shows wholly or partly lipophilic residues.

Preferred are those components (C) which are reaction products of an epihalohydrin and/or a compound containing more than one halohydrin group and an organic compound containing more than one primary and/or secondary amino group, the ratio of the halohydrin groups to the hydrogen atoms bound to the amino nitrogen atoms being 0.6:1 to 1.5:1, and the reaction product containing a lipophilic radical of at least 8 carbon atoms.

The used amounts of the mentioned substances for the manufacture of the reaction products (C) are described in detail in the mentioned patent specifications (see also patent claims). The manufacture is indicated, too. In general the starting materials are reacted with each other up to 1 hour at increased temperature in aqueous, aqueous/alcoholic or alcoholic solution and then-if necessary-the reaction is stopped by the addition of volatile acids, e.g. acetic acid or hydrochloric acid and the desired concentration is adjusted with water.

As already mentioned above it is especially advantageous to employ the reaction products (C) as emulsifiers for the organo polysiloxanes mentioned as above, since by this a simplified storage and bath preparation is possible. Moreover, better water-repellent effects are obtained in this case. Especially those reaction products (C) are preferred the manufacture of which is described in U.S. Pat. Nos. 3,320,197 and 3,211,580. With these products especially good water-repellent effects are obtained.

The treating baths can simply be prepared by mixing the components (A), (B) and (C) and diluting with water as well as adjusting the pH-value to 5.5 to 7.5, especially 6 to 7 in known manner with preferably volatile acids. Here such an amount of the polysiloxane emulsion (A) of usually 20 to 40% by weight is employed so that the bath contains at least 6, especially 8 to 50 g organo polysiloxane per liter. Of the poly silicic acid ester dispersion (B) which generally contains 35 to 65% by weight poly silicic acid ester, 2 to 30 g, especially 2 to 20 g per liter finishing bath are used. The reaction product (C) which is, in general, an 8 to 25% solution, is used in such amounts that at least 6% by weight, especially 10 to 40% by weight of a 100% reaction product (C), referred to the organo polysiloxane, are present in the bath. If the reaction product (C) is used as emulsifier for the organo polysiloxane emulsion (A), and this is preferred, the same amounts are applied and a subsequent addition of (C) is naturally superfluous.

The obtained finishing baths are extremely resistant so that the good water-repellent effects can still be obtained after a retention time of 12 to 24 hours.

The finishing bath is applied upon the material in usual amounts by padding, nip-padding, spraying or other known methods (bath absorption of about 40 to 120% by weight on the weight of the fibrous material) and subsequently finished by simple heating. Generally it is dried at up to 100° C. and cured at 130° to 170° C. for about 2 to 5 minutes. It is, however, also possible to carry out the after-treatment during 10 to 20 minutes at 110° C. It is a special advantage of the process according to invention that already low temperatures are sufficient in order to obtain good water-repellent effects.

The present process for making fibrous material, especially textiles, water-repellent can be combined with a usual creaseproof finish. Here the known synthetic resins can be applied. As catalysts usual compounds, such as magnesium chloride, Zn-salts and aminehydrochlorides are suitable.

Fibrous materials of all kind can be treated in the described manner. Fibrous materials should comprise herein leather, synthetic leather, paper, non-wovens and especially textiles. The fibrous material preferably consists of natural or regenerated cellulose or mixtures of cellulose with animal or synthetic fibres. Naturally, also fibrous materials which contain animal, especially wool, or synthetic fibres, especially polyester-, polyamide and polyacrylo nitrile fibres solely or mixed with each other, can be finished according to the invention. Cellulose or cellulose containing textiles are preferably made water-repellent.

The advantages of the process according to the invention compared with the indicated prior art are above all the essentially improved water-repellent effect. It could not be expected that the water-repellent effects are improved in such an outstanding manner by using the poly silicic acid esters instead of the simple silicic acid esters together with the reaction products (C). While, indeed, according to prior art the water-repellent effects are completely insufficient without alkyl hydrogen polysiloxanes, one obtains according to the process according to the present invention a water-repellent effect in the absence of organo hydrogenpolysiloxanes, as it could up to now only be achieved while using concurrently alkyl hydrogenpolysiloxanes. The effects are especially favourable if the reaction products (C) are used just from the beginning as emulsifiers for the organo polysiloxane emulsions.

The standards for the water-repellent effect indicated in the following examples were determined according to DIN 53 888.

EXAMPLE 1

A cotton poplin fabric (approx. 230 g/m$^2$) is impregnated with an aqueous bath which contains 125 g/l of the following emulsion and 40 g/l of the epoxyamine reaction product used in example 1 of U.S. Pat. No. 3,320,197 (pH-value 7.2), is squeezed to a weight increase of 72% and then dried for 10 minutes at 100° C. and cured for 5 minutes at 150° C.

The so finished fabric has a water absorption of 17% and a very good water-repellent effect (4/4/4).

The used emulsion was prepared as follows.

1830 g water and 600 g of a 10% polyvinyl alcohol solution are prepared (polyvinyl alcohol with a saponification number of 140 and a viscosity of 25 mPa.s at 20° C. in a 4% solution) and a solution of 360 g dimethyl polysiloxane end-blocked with OH-groups (5000 mPa.s at 20° C.) and 60 g ethyl polysilicate (data see example 2) are emulsified with quick stirrer into 750 g methylene chloride and subsequently the whole is homogenized on the high pressure homogenizing machine at 200 bar, the temperature being kept at under 25° C.

For comparison the same cotton poplin is finished according to prior art (DE-AS 12 82 597), whereby as well 125 g/l of the emulsion are added which contains, however, instead of the ethyl polysilicate the same amount of silicic acid tetraisopropyl ester and instead of the epoxyamine reaction product the catalyst solution indicated in the example of the mentioned reference. The pH-value of the finishing bath is 7.2, as in example 1, above.

The so finished fabric has a water absorption of 72% and an insufficient water-repellent effect (1). Thus the superiority of the process according to invention becomes quite obvious.

EXAMPLE 2

For the manufacture of finishing baths the following emulsions are prepared.

650 g of the epoxyamine reaction product used in example 7 of U.S. Pat. No. 3,320,197 and 20 g water are prepared and in this solution a solution of 250 g dimethylpolysiloxane end-blocked with OH-groups (viscosity see example 1) into 80 g tetrachloroethylene are emulsified with a quick stirrer and the obtained pre-emulsion is homogenized on a high pressure homogenizing machine at 300 bar and 30° C. at the maximum.

240 g of a 10% polyvinyl alcohol solution (data see example 1) and 310 g water are prepared and into this solution 450 g ethyl polysilicate (average molecular weight 610; density 20° C., 1.05 to 1.06) are stirred with a quick stirrer and the obtained pre-emulsion is homogenized at 200 bar and 20 to 25° C.

BATH A 40 g/l of the organo polysiloxane emulsion and 8 g/l of the ethyl polysilicate emulsion.

The pH-value of the bath is 7.3.

BATH B

Like bath A, wherein additionally 20 g/l of the condensation product manufactured according to example 1 of U.S. Pat. No. 4,102,840 and 6 ml/l of a 30% aqueous zinc nitrate solution (pH-value approx. 1) are added. The pH-value of the bath is 6.5.

BATH C

Like bath B, wherein, however, 6 g/l magnesium chloride hexahydrate are employed as catalyst. The pH-value of the bath is 6.9.

BATH D

Like bath B, but with 8 ml/l of an aqueous 40% 2-amino-2-methyl-propanolhydrochloride solution (pH-value approx. 7) as catalyst. The pH-value of this bath is as well 6.9.

With these baths the cotton poplin mentioned in example 1 is finished immediately after manufacture, after 2 hours and 12 hours retention time under the conditions mentioned in example 1. The obtained water-repellent effects are detailed in the following indicated table (a=water absorption; b=water-repellent effect):

| | water absorption/water repellency | | | | | |
|---|---|---|---|---|---|---|
| | immediately after manufacture | | after 2 hours | | after 12 hours | |
| | a | b | a | b | a | b |
| bath A | 12% | 4/4/4 | 13% | 4/4/4 | 14% | 4/4/3 |
| bath B | 10% | 4/4/4 | 10% | 4/4/4 | 11% | 4/4/4 |
| bath C | 10% | 4/4/4 | 12% | 4/4/4 | 17% | 4/3/3 |
| bath D | 11% | 4/4/4 | 11% | 4/4/4 | 18% | 4/3/2 |

If in the baths A to D the pH-value is adjusted with 60% acetic acid to 5.0 (bath A), 5.6 (bath B), 5.6 (bath C) and 5.8 (bath D), the initial effects are somewhat lower but the stability of the baths is increased by this and the effects are not deteriorated even when finishing (impregnation) is carried out 12 hours after the manufacture of the baths.

EXAMPLE 3

A bath for finishing cotton poplin with about 200 g/m$^2$ is prepared as follows.

40 g of an organo polysiloxane emulsion (manufacture see example 2, wherein, however, a $\alpha,\beta$-dipropoxydimethylpolysiloxane with a viscosity of 20.000 mPa.s is used) and 18 g/l of a butyl polysilicate emulsion (manufacture according to example 2; average molecular weight of the butyl polysilicate 700) are dispersed in one liter water. The pH-value of the bath adjusts itself to 7.2 (bath A). Besides, the pH-value is adjusted to 6.5 (bath B) with acetic acid.

With these baths the above described cotton poplin is padded (weight increase about 65%) and then dried for 15 minutes at 110° C.

The obtained effects are stated in the following table:

| | water absorption/ water repellency | |
|---|---|---|
| | a | b |
| bath A | 13% | 4/4/4 |
| bath B | 17% | 4/4/3 |

It is, indeed, possible according to the process according to invention to obtain very good water-repellent effects even by simple drying.

EXAMPLE 4

A cotton poplin (150 g/m$^2$) is padded (weight increase about 68%) with an aqueous bath which contains per liter 40 g of the $\alpha,\beta$-dihydroxydimethylpolysiloxane emulsion manufactured according to example 4 of GB-PS 1 404 356, 15 g of the epoxyamine reaction product manufactured according to example (1 a) of GB-PS 1 056 808 and 10 g of the ethyl polysilicate emulsion manufactured according to example 2 and subsequently dried at 110° C. for 20 minutes and cured.

The so finished fabric shows a very good water-repellency.

EXAMPLE 5

For finishing polyester/cotton mixed fabric 65:35 (220 g/m$^2$) and polyester/viscose staple fibre mixed fabric 67:33 (300 g/m$^2$) following aqueous baths are prepared:

BATH A 40 g/l of the organo polysiloxane emulsion described in example 2, 8 g/l of a methyl polysilicate emulsion (average molecular weight 360 to 470; density at 20° C. 1.14 to 1.16; manufacture analogous to the indications in example 2). The pH-value of the solution adjusts itself to 7.5.

BATH B

Like bath A, wherein 20 g/l of a 75% aminoplast resin solution (dimethylol dihydroxy ethylene urea etherified with methanol) and 8 g/l of a 40% aqueous 2-amino-2-methylpropanol hydrochloride solution (pH-value 7.2) are used in addition.

BATH C

Like bath B, wherein, however, 30 g/l of a 60% pentamethylol melamine etherified with methanol are employed as aminoplast resin solution (pH-value 6.8).

BATH D

Like bath B, wherein, however, 30 g/l of a 68% mixture of hexamethylolmelamine etherified with methanol and dimethylol urea etherified with methanol in the ratio 6:4 is employed as aminoplast resin (pH-value 6.7).

The above mentioned fabrics are padded with the indicated baths (weight increase 55 to 60%), then dried for 10 minutes at 100° C. and cured for 3 minutes at 160° C. The obtained effects are stated in the following table:

| | water absorption/water repellency | | | |
|---|---|---|---|---|
| | polyester/cotton mixed fabric | | polyester/viscose staple fibre mixed fabric | |
| | a | b | a | b |
| Bath A | 6% | 4/4/4 | 13% | 4/4/3 |
| Bath B | 10% | 4/4/4 | 11% | 4/4/4 |
| Bath C | 6% | 4/4/4 | 7% | 4/4/4 |
| Bath D | 8% | 4/4/4 | 7% | 4/4/4 |

The good results show significantly the superiority of the process according to the invention.

EXAMPLE 6

For the manufacture of finishing baths the following organo polysiloxane emulsions are prepared.

25 g of an aqueous/alcoholic solution of cetyl dimethyl benzylammoniumchloride (50%) and 650 g water are prepared and into this solution a solution of 250 g $\alpha,\beta$-dihydroxydimethyl polysiloxane (viscosity 750 mPa.s at 20° C.) in 80 g tetrachloroethylene are emulsified with a quick stirrer and the obtained pre-emulsion is homogenized on a high pressure homogenizing machine at 300 bar and 30° C. at the maximum (emulsion A).

In the same way an emulsion is prepared while using 5 g nonyl phenol polyglycol ether (adduct of 10 mols of ethylene oxide and 1 mol of nonylphenol) as emulsifier (emulsion B).

BATH A 40 g/l of the organo polysiloxane emulsion (A), 20 g/l of a solution of an epoxyamine reaction product (manufacture see example 7 of U.S. Pat. No. 3,320,197) and 22 g/l of the ethyl polysilicate emulsion described in example 2.

BATH B

Like bath A, but with 30 g/l of the epoxyamine reaction product.

BATH C

Like bath A, but with 40 g/l of the organo polysiloxane emulsion (B).

BATH D

Like bath C, but with 30 g/l of the epoxyamine reaction product. The pH-value of the baths A to D is at 7.1 to 7.3.

With these baths the cotton poplin mentioned in example 1 is finished under the conditions indicated there. The obtained water-repellent effects are listed in the following table:

| | water absorption/ water repellency | |
|---|---|---|
| | a | b |
| Bath A | 15% | 4/4/4 |
| Bath B | 12% | 4/4/4 |
| Bath C | 17% | 4/4/4 |
| Bath D | 14% | 4/4/4 |

What we claim is:

1. A process for making fibrous material water-repellent, which comprises treating the fibrous material with an aqueous bath containing
   (A) an emulsified organopolysiloxane with at least 2 modified or unmodified, crosslinkable, hydroxyl groups,
   (B) an emulsion of a polysilicic acid ester of a monovalent alcohol with 1 to 4 carbon atoms, which has been emulsified by the aid of a non-ionic emulsifier, and shows a pH-value of 5 to 7.5, and
   (C) a reaction product of an organic compound containing at least one halohydrin group or epoxy group or both and an organic compound containing hydrogen atoms bound to nitrogen, which reaction product is water-soluble or at least water-dispersible when in form of its salt.

2. A process according to claim 1, wherein the emulsified organopolysiloxane of component (A) is a dimethylpolysiloxane terminated by hydroxyl groups.

3. A process according to claim 1, wherein component (C) is a reaction product of an epoxy compound and a diamine or polyamine, the ratio of epoxy groups to amine hydrogen atoms being 1:0.33 to 10.

4. A process according to claim 1, wherein component (C) is a reaction product of 0.25 to 2.5 mols of an epoxy compound containing per mol on the average more than one epoxy group, and 1 mole of a compound selected from urea, imino urea and derivatives thereof.

5. A process according to claim 4, wherein the reaction product of compound (C) has been further reacted with 0.1 to 2 mols of an amine of the formula

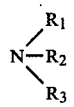

wherein $R_1$ is alkyl of 2 to 4 carbon atoms or hydroxyalkyl of 2 to 5 carbon atoms, $R_2$ and $R_3$ are independently hydrogen, alkyl of 1 to 4 carbon atoms or hydroxyalkyl of 2 to 5 carbon atoms, and wherein the amine has at least 2 reactive hydrogen atoms in the molecule.

6. A process according to claim 1, wherein component (C) is a reaction product of an epihalohydrin or a compound containing more than one halohydrin group and an amine containing more than one primary or secondary amino group, the ratio of the halohydrin groups to the hydrogen atoms bound to the amino nitrogen atoms being 0.6:1 to 1.5:1 and wherein the reaction product contains a lipophilic radical of at least 8 carbon atoms.

7. A process according to claim 1, wherein the polysilicic acid ester is an ethylpolysilicate.

8. A process according to claim 1, wherein component (C) is the emulsifier for the organo polysiloxane (A).

* * * * *